US007919731B2

(12) United States Patent
McFadden et al.

(10) Patent No.: US 7,919,731 B2
(45) Date of Patent: Apr. 5, 2011

(54) STIRRING HOT PLATE

(75) Inventors: Curt McFadden, Dubuque, IA (US); Kenneth David Hermsen, Dubuque, IA (US); Roger W. Earle, Dubuque, IA (US); James R. Edwards, Dubuque, IA (US); Kerry W. Leppert, Dubuque, IA (US); Eric Jackson, Dubuque, IA (US); Eric Garz, Platteville, WI (US); Mark Lockwood, Dubuque, IA (US); John L. Meek, Rock Hill, SC (US)

(73) Assignee: Barnstead/Thermolyne Corporation, Marietta, OH (US)

( * ) Notice: Subject to any disclaimer, the term of this patent is extended or adjusted under 35 U.S.C. 154(b) by 331 days.

(21) Appl. No.: 11/928,116

(22) Filed: Oct. 30, 2007

(65) Prior Publication Data

US 2008/0047954 A1 Feb. 28, 2008

Related U.S. Application Data

(62) Division of application No. 11/283,948, filed on Nov. 21, 2005, now abandoned, which is a division of application No. 10/922,438, filed on Aug. 20, 2004, now Pat. No. 7,075,040.

(60) Provisional application No. 60/547,377, filed on Feb. 24, 2004, provisional application No. 60/496,744, filed on Aug. 21, 2003.

(51) Int. Cl.
*H05B 1/02* (2006.01)

(52) U.S. Cl. ..... 219/494; 219/506; 219/445.1; 99/348; 241/101.2

(58) Field of Classification Search ..... 219/494, 219/497, 429–430, 433, 458, 445.1, 448.12, 219/448.11, 506; 366/146, 273, 274; 241/101.2, 241/101.8; 99/348, 510
See application file for complete search history.

(56) References Cited

U.S. PATENT DOCUMENTS

| | | | |
|---|---|---|---|
| 3,028,476 | A | 4/1962 | Hug |
| 3,138,370 | A | 6/1964 | Anderson et al. |
| 3,539,156 | A | 11/1970 | Zipperer et al. |
| 3,554,497 | A | 1/1971 | Zipperer |
| 3,766,360 | A | 10/1973 | Eddleman et al. |
| 3,790,346 | A | 2/1974 | Ritchie |
| 3,834,116 | A | 9/1974 | Inoue et al. |

(Continued)

FOREIGN PATENT DOCUMENTS

DE 34 02 041 A1 7/1985

(Continued)

OTHER PUBLICATIONS

Troemner LLC, Drawing and Schematic for "Panel, Front Membrane Switch 575 HPS", 3 pages, Apr. 2002.

(Continued)

*Primary Examiner* — Mark H Paschall
(74) *Attorney, Agent, or Firm* — Woods, Herron & Evans, LLP

(57) ABSTRACT

A stirring hot plate for simultaneously heating and stirring a mixture includes a phase controlled motor that spins magnets which couple to, and thereby spin, a stir bar within the mixture. In addition to spinning the magnets, the motor includes an operational mode in which the motor is rapidly braked thereby quickly spinning down the stir bar. The stirring hot plate also includes a visual indicator to the user that the platform is hot-to-the-touch that is especially effective when the stirring hot plate is not in use.

19 Claims, 4 Drawing Sheets

U.S. PATENT DOCUMENTS

| | | | | |
|---|---|---|---|---|
| 4,450,397 | A | 5/1984 | Painter et al. | |
| 4,483,623 | A | 11/1984 | Eaton et al. | |
| 4,512,666 | A | 4/1985 | O'Connell | |
| 4,518,264 | A | 5/1985 | Nohso | |
| 4,673,297 | A | 6/1987 | Siczek et al. | |
| 4,747,693 | A | 5/1988 | Kahl | |
| 4,911,556 | A | 3/1990 | Lim et al. | |
| 5,121,991 | A | 6/1992 | Wakatake | |
| 5,176,446 | A | 1/1993 | Chiba et al. | |
| 5,183,564 | A | 2/1993 | Hong | |
| 5,241,158 | A | 8/1993 | Schreder | |
| 5,294,779 | A | 3/1994 | Miquelot | |
| 5,464,966 | A | 11/1995 | Gaitan et al. | |
| 5,499,872 | A | 3/1996 | Baxter | |
| 5,513,912 | A | 5/1996 | Lotz et al. | |
| 5,529,391 | A | 6/1996 | Kindman et al. | |
| 5,533,800 | A | 7/1996 | Stiegelmann et al. | |
| 5,547,280 | A | 8/1996 | Wanninger et al. | |
| 5,549,382 | A | 8/1996 | Correia, II et al. | |
| 5,816,058 | A | 10/1998 | Lee et al. | |
| 5,834,739 | A | 11/1998 | Lockwood et al. | |
| 5,899,567 | A | 5/1999 | Morris, Jr. | |
| 6,236,177 | B1 | 5/2001 | Zick et al. | |
| 6,318,247 | B1 | 11/2001 | Di Nunzio et al. | |
| 6,517,231 | B1 | 2/2003 | Biardeau et al. | |
| 6,531,056 | B2 | 3/2003 | Hammonds | |
| 6,587,739 | B1 * | 7/2003 | Abrams et al. | 700/83 |
| 6,712,497 | B2 | 3/2004 | Jersey et al. | |
| 6,793,167 | B2 | 9/2004 | Karkos, Jr. et al. | |
| 2001/0002892 | A1 | 6/2001 | Karkos, Jr. et al. | |
| 2001/0019228 | A1 | 9/2001 | Gremm | |
| 2002/0011480 | A1 | 1/2002 | Schilling et al. | |
| 2002/0092839 | A1 | 7/2002 | Lu et al. | |
| 2004/0130282 | A1 | 7/2004 | Meyer et al. | |

FOREIGN PATENT DOCUMENTS

| | | |
|---|---|---|
| GB | 2 224 171 A | 4/1990 |
| JP | 63151342 | 6/1988 |

OTHER PUBLICATIONS

Troemner LLC, A Photograph of Model 575 Stirrer/Hot Plate, and an Enlarged Photograph of the Face Plate of that Model, 2 pages, no date.

Troemner LLC, Instruction Manual Model 575 Hotplate-Stirrer, 6 pages, Revised Aug. 2002.

Barloworld Scientific, Information Brochure for Stuart Brand Hotplates, 7 pages, no date.

ECOMCAT, Information Brochure for Jencons-PLS Hotplates, 4 pages, no date.

Barloworld Scientific, Jenway.com Website Printout of Jenway Hotplates, 3 pages, Download Date Oct. 13, 2005.

Troemner LLC, Troemner Series 400 Hot Plate/Stirrer Instructions Manual, 5 pages, no date.

Torrey Pines Scientific, torreypinesscientific.com Website Printout of ECHOTHERM Digital Hot Plates and Hot Plate/Stirrers Models HP30 and HS30, 8 pages.

Barnstead International, Operation Manual and Parts List for MIRAK Hot Plates, Stirrers and Stirring Hot Plates, pp. 1, 2, 7 and 9-14, dated Sep. 19, 2002.

Ballard, Spahr, Andrews & Ingersoll, L.L.P., Letter to Alan M. Doernberg, Esq. Of Fisher Scientific Co., LLC, 2 pages, dated Oct. 19, 2005.

Torrey Pines Scientific, Echotherm™ Model HS40 Fully Programmable Digital Stirring Hot Plates, http://www.torreypinesscientific.com/hs40, downloaded Jan. 16, 2003.

Barnstead-Thermolyne Corporation, MIRAK™ Hot Plates, Stirrers and Stirring Hot Plates, Operation Manual and Parts List.

VWR Scientific, Hot Plates, Stirrers, Product Brochure, pp. 692-693, 1994.

VWR Scientific, Series 400HPS Microprocessor-controlled Hot Plate/Stirrer, Instruction Manual, 5 pages, no date.

Fairchild Semiconductor, ML4423 Application Guidelines, pp. 1-19, dated Apr. 1998 (Rev. 1.0 Oct. 25, 2000).

Corning, Instruction Manual for Corning Hot Plates, Stirrers and Stirrer/Hot Plates, 7 pages, Jul. 2002.

* cited by examiner

STIRRING HOT PLATE

RELATED APPLICATIONS

The present application is a Divisional of application Ser. No. 11/283,948, filed on Nov. 21, 2005, which is a Divisional of application Ser. No. 10/922,438, filed on Aug. 20, 2004, now U.S. Pat. No. 7,075,040, which claims the benefit of U.S. Provisional Patent Application Ser. Nos. 60/496,744, filed on Aug. 21, 2003 and 60/547,377, filed Feb. 24, 2004, all of which are hereby expressly incorporated by reference herein.

FIELD OF THE INVENTION

This invention relates generally to laboratory equipment and more particularly, to stirring hot plates.

BACKGROUND OF THE INVENTION

Stirring hot plates are widely used in the chemical, medical, food and agricultural technology industries. A stirring hot plate has a stationary base on which the fluid container rests. A magnetic stir bar is inserted into the container, and the magnetic stir bar is coupled by a magnetic field to magnets located beneath the table. Rotating the magnets beneath the table rotates their coupling magnetic fields and causes a corresponding rotation of the magnetic stir bar in the liquid. Simultaneously with the stirring action, the fluid can be heated to a desired temperature.

Often, a user desires to execute successive identical magnetic stirring processes. With known magnetic stirrers, this can be accomplished with two methods. With a first method, when a first process is completed, the stirrer is turned off; the fluid containers exchanged and stirrer restarted. However, with some magnetic stirrers, the stirring speed set point may be lost and have to be reset. With a second method, when a first stirring process is done, the user simply lifts the fluid container off of the stirrer without stopping the stirring motor, stirrer, thereby abruptly decoupling the magnetic stir bar from the magnet. That abrupt decoupling results in the magnetic stir bar clanging around in the beaker. When the second next fluid container is placed on the stirrer, depending on the stirring speed, the magnetic stir bar may not automatically couple; and the stirring speed must be reduced until a magnetic coupling is achieved. Thus, there is a need for a stirrer cycle that permits fluid containers to be quickly unloaded from and loaded onto the stirrer with a minimum of user intervention and unnecessary stirring bar motion.

During operation of a stirring hot plate, the platform on which the container rests is often heated to a temperature that is hot-to-the-touch; and many stirring hot plates provide a visual indicator that is on whenever the temperature of the hot stirring plate exceeds a hot-to-the-touch temperature. When the stirring hot plate is operating, users are normally aware of the potential for the platform to be hot-to-the-touch; and they are more careful. However, after an operating cycle, when the power is turned off and the fluid container removed, users are less likely to be conscious of the platform being hot-to-the-touch and may not see the illuminated hot-to-the-touch indicator. Therefore, there is a further need to provide an improved indication to the user that the platform is hot-to-the-touch.

SUMMARY OF THE INVENTION

Embodiments of the present invention provide an improved stirring hot plate that provides an improved visual indicator to the user that the platform is hot-to-the-touch, and that visual indicator is especially effective when the stirring hot plate is not in use.

Additional embodiments provide a stirring hot plate which can rapidly brake the magnets which cause a magnetic stir bar to rotate within a mixture container.

These and other objects and advantages of the present invention will become more readily apparent during the following detailed description taken in conjunction with the drawings herein.

DETAILED DESCRIPTION OF THE INVENTION

Figure 1:
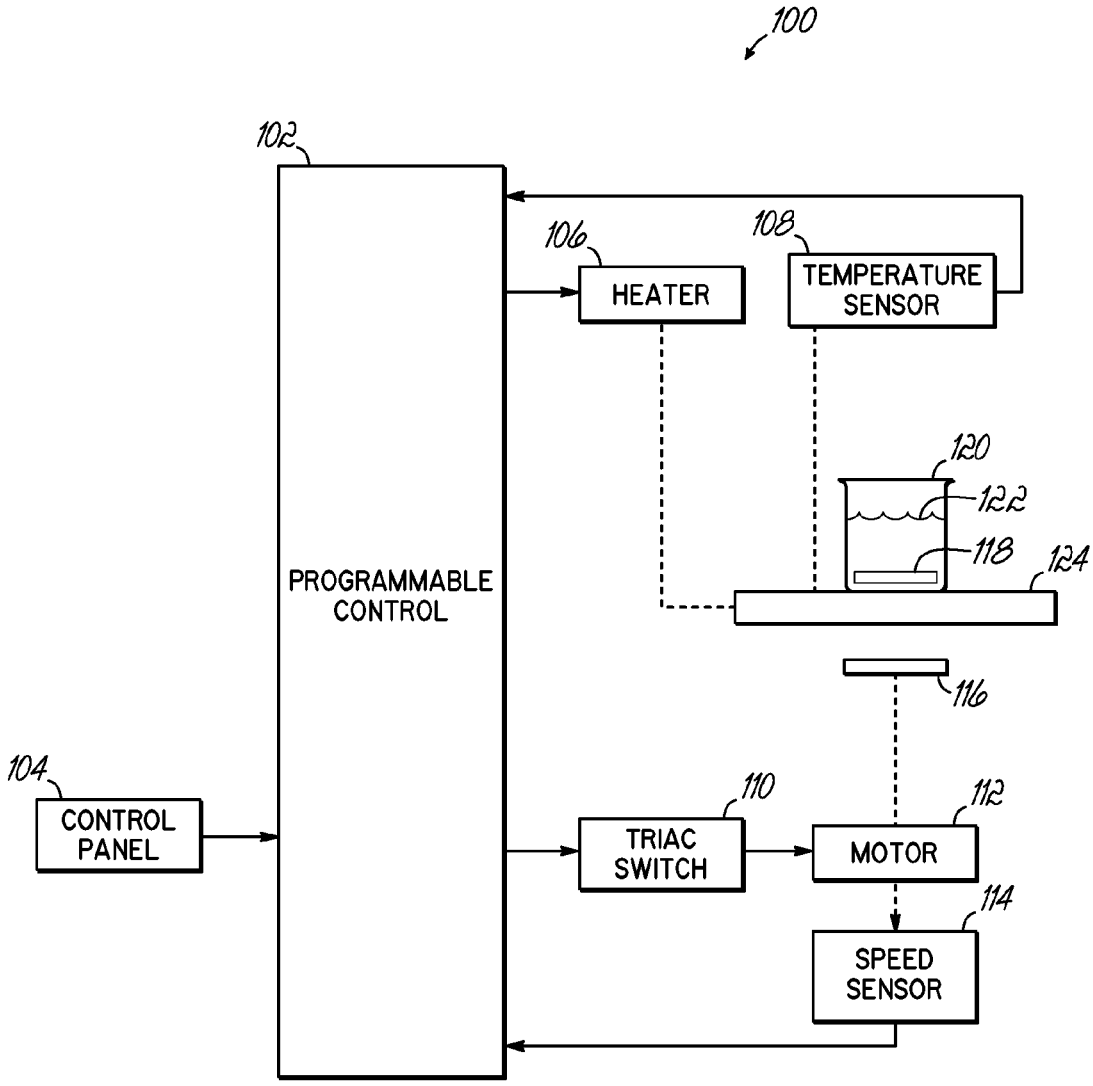
FIG. 1 depicts a block diagram of the major subassemblies of an exemplary stirring hot plate.

FIG. 1 illustrates, in block diagram form, the major components of an exemplary stirring hot plate 100.

Figure 4:
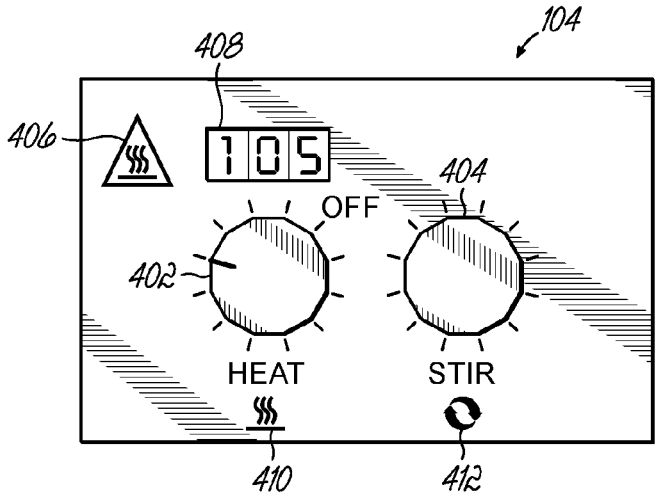
FIG. 4 illustrates an exemplary control panel for the stirring hot plate of FIG. 1.

A control panel 104 provides the interface to a user operating the hot plate. An exemplary control panel is shown in FIG. 4 and includes input devices, such as control knobs 402, 404, that permit a user to adjust the heat and stirrer settings of the hot plate. By using these knobs, a desired temperature and RPM setting can be input to the controller 102.

The control panel 104 also includes output devices, such as LEDs 406, 410, 412 and 7-segment displays 408, that provide to a user indication of how the hot plate is operating. For example, the control panel 104 can display the current temperature of the hot plate or the temperature set point, the stirrer setting, or whether the hot plate is on or off. One particularly useful display is an indicator of whether the hot plate's surface 124 remains hot even though the hot plate has been turned off. One of ordinary skill will readily appreciate that not all the LEDs in the control panel are required; for example, LEDs 410 and 412 can be omitted and replaced by appropriate graphical symbols to assist a user in identifying the controls.

The hot plate includes a programmable controller 102 that manages the operation of the hot plate according to an embedded software routine. One of ordinary skill will appreciate that controller 102 can be implemented using a variety of equivalent hardware devices and software applications.

Based on the temperature setting, or set point, entered via the control panel 104, the controller 102 energizes a heater 106 that warms the hot plate's surface 124. A temperature sensor 108, such as an RTD or a thermocouple, can be used to sense the temperature and provide feedback to the controller 102. In this way the controller 102 can maintain the proper temperature of the hot plate surface 124.

The control of the motor 112 may be accomplished in a number of ways in order to operate the hot plate at the desired RPMs. The present invention does not require any specific method for controlling the motor 112; however, an exemplary motor control embodiment is described below that provides a number of advantages and benefits.

Typically, the controller 102 controls the speed of the motor 112 by turning on and off a triac 110. One exemplary embodiment of the present hot plate uses a triac 110 along with a shaded pole motor 112 to rotate the magnets 116 within the hot plate at a desired speed. The rotating magnets couple with a magnetic stir bar 118 in a container 120 on top of the hot plate surface 124, so that a mixture 122 in that container will be stirred as well. In some embodiments, unlike the schematic drawing of FIG. 1, the triac 110 may be a part of the programmable control 102.

Figure 2:
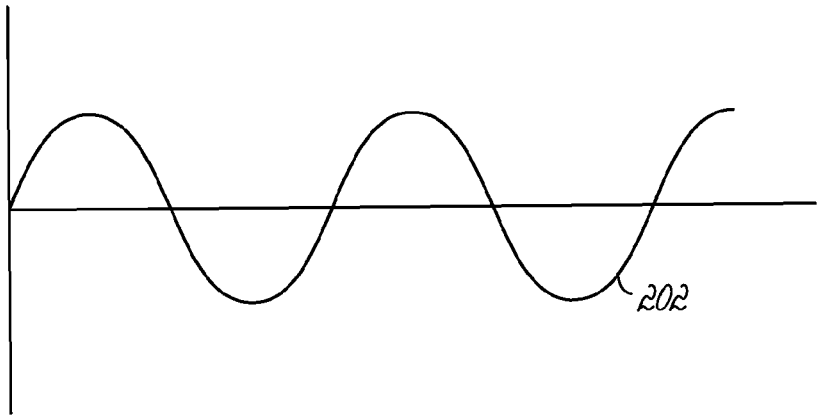
FIG. 2 illustrates a full-power alternating-current (AC) waveform.
Figure 3A:
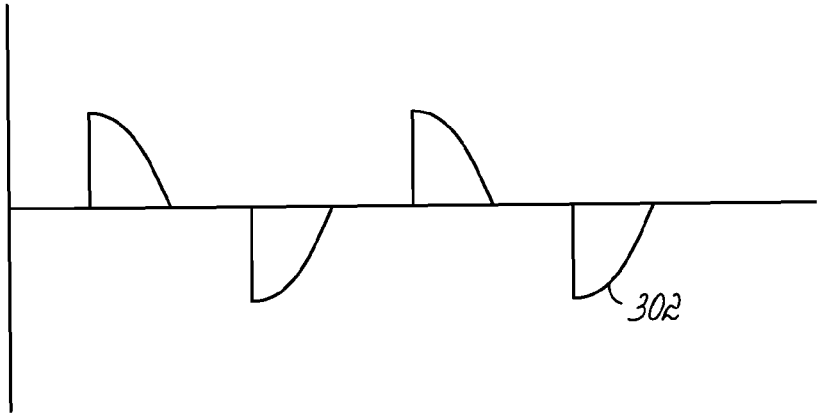
FIG. 3A illustrates a phase-controlled waveform having substantially a 50% duty-cycle as compared to the waveform of FIG. 2.

FIG. 2 depicts an AC waveform 202 that could be used to energize the motor 112. However, to obtain accurate and stable control of the motor speed, phase control can be introduced through the use of the triac 110. The triac can be turned on (i.e., allowing current flow) for a portion of the waveform of FIG. 2 and then switched off at a zero crossing. A phase controlled waveform 302 is illustrated in FIG. 3A. In particular, the waveform 302 has a 50% duty cycle.

The power to the motor 112 is a ratio of the area under the waveform 302 versus that of the full AC waveform 202, which in this case is 50%. Speed is not linearly related to the power supplied to the motor so the motor speed resulting from waveform 302 will be less than 50% of that which would result from waveform 202.

Embodiments of the present invention permit the stirrer speed to be adjusted from approximately 50 RPM to approximately 1200 RPM. This range of speeds corresponds to a duty cycle range of approximately 25% to approximately 95%. However, one of ordinary skill will appreciate that other duty cycles and speed ranges are contemplated within the scope of the present invention. The specific correlation between duty cycle and speed depends on a number of factors, however, such as the fluid's viscosity, the temperature of the fluid, motor efficiency, the stir bar mass and shape, the flask shape and the material of the flask.

In addition to this usable duty cycle range, the triac and motor can be utilized to brake a magnetic stir bar. With known hot plates, the stirring action is terminated by disconnecting power from the motor thereby stopping the rotating magnets which results in the magnetic stir bar slowly spinning down within whatever mixture is on the hot plate.

Figure 3B:
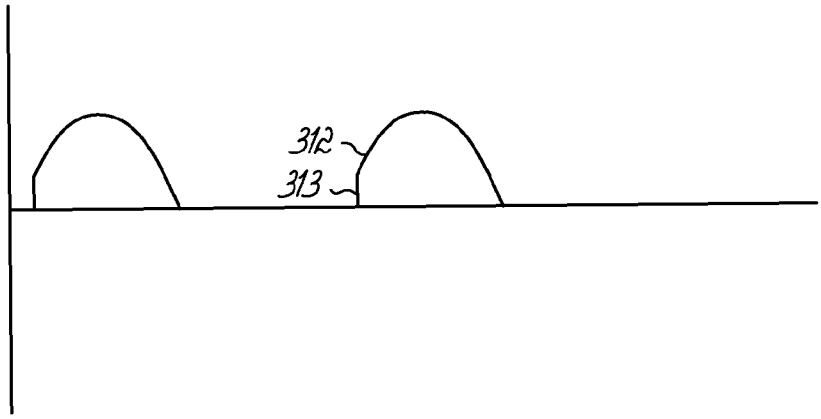
FIG. 3B illustrates a waveform having substantially 95% of a positively rectified portion of the waveform of FIG. 2.

However, embodiments of the present invention include an operational mode in which the motor 112 is rapidly braked so as to quickly slow the magnets 116 and any coupled magnetic stir bar 118. In particular, when a user turns off the stirrer control, the controller 102 detects this condition and operates the triac accordingly. In particular, the waveform 312, of FIG. 3B is a positively rectified waveform having substantially a 50% duty cycle. The exemplary waveform 312 is a positively rectified version of the waveform 202 of FIG. 2; however, a negatively rectified waveform can also be used. Additionally, the exemplary waveform 312 is cut off around region 313 slightly before a zero-crossing. By doing so, the programmable control 102 can ensure that no power of the opposite polarity is inadvertently applied to the motor 106 due to the finite timing constraints of real-world triacs and control circuitry. Allowing anywhere from 70% to 90% of the possible waveform 312 to be applied to the motor 106 before cutting it off is sufficient to prevent unintended application of power to the motor 106. In alternative embodiments of the present invention, no portion of the exemplary waveform 312 is cut off thereby providing 100% of the positively rectified waveform. In other embodiments, waveforms having less than 70% duty cycle can accomplish the braking action as well. Alternatively, instead of a rectified waveform, a DC waveform may be applied to the motor as well to initiate braking action.

Operating the motor according to the waveform 312 for approximately one to four seconds, such as 1.6 seconds, can quickly stop the motor rotation even from a high speed setting, such as, for example, 1200 rpm. As a result, a magnetic stir bar can be quickly stopped and a vortex within a stirrer mixture can be quickly collapsed if needed. If desired, a speed sensor 114 can be coupled with the rotating shaft (not shown) to sense the motor's speed and provide it as feedback to the controller 102. The motor speed can be used, for example, to determine when braking action can be terminated. For example, when a desired speed is reached (such as 0 RPM), the controller 102 can cease applying the braking action.

Figure 7:
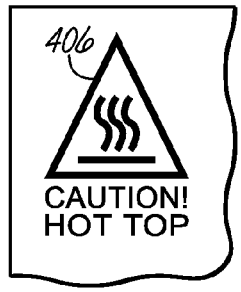
FIG. 7 illustrates a detailed view of the hot top caution symbol.

As previously mentioned, an exemplary control panel 104 is illustrated in FIG. 4. The knob 402 on the left adjusts the temperature setting while the knob 404 on the right adjusts the stirrer speed. An indicator 406, for example the international symbol for a hot surface, is shown that is illuminated when the hot plate surface is above a predetermined temperature, such as 50° C. A more detailed view of this indicator is shown in FIG. 7 in which the symbol is accompanied by the text "CAUTION HOT TOP." This indicator alerts a user of the hot surface. Also, a seven segment display 408 or other equivalent display is provided that shows either a temperature set point or the current temperature of the hot plate surface. Other LEDs 410 and 412 can be used to alert a user that the heat and stirrer controls are active.

Figure 5:
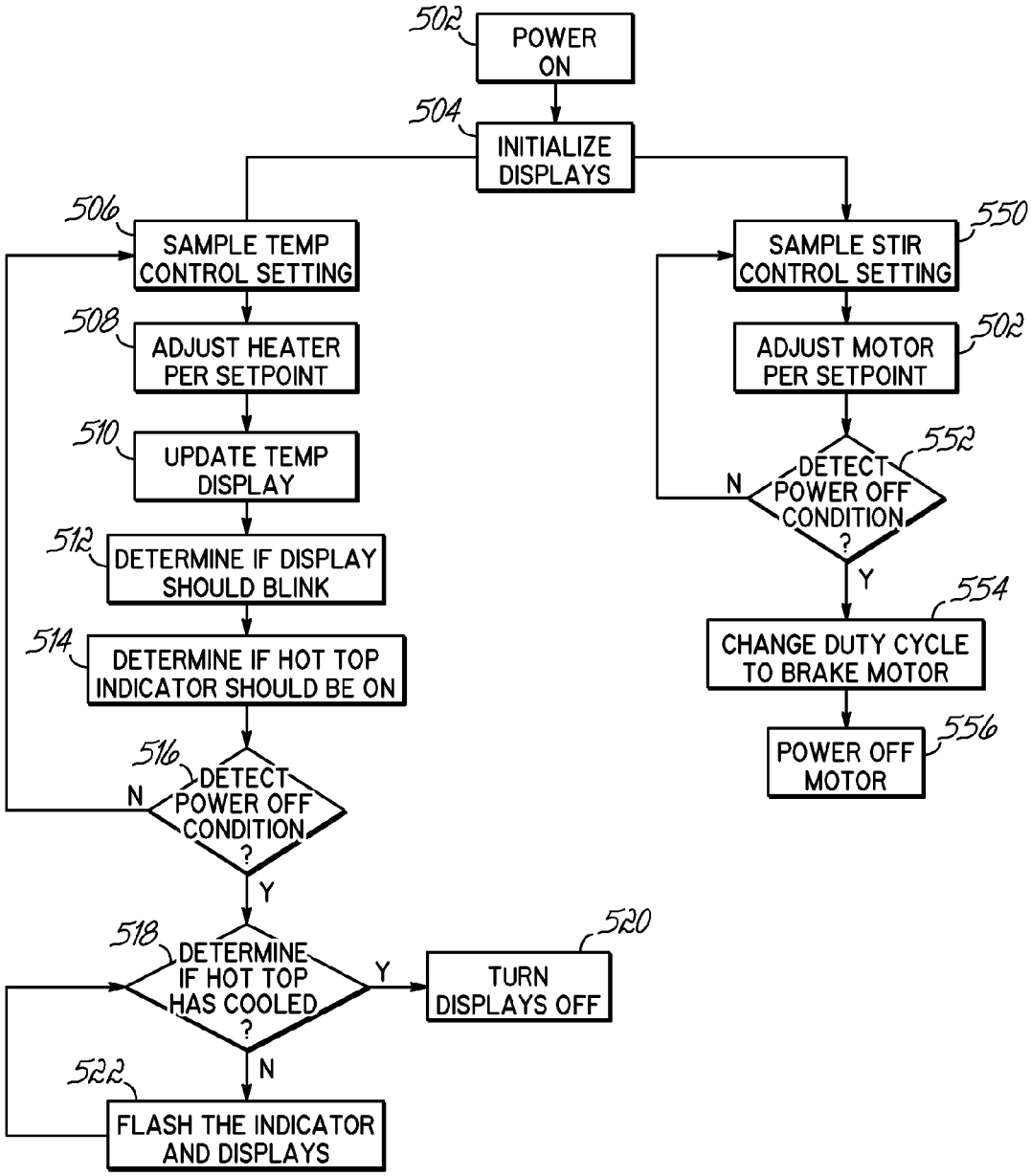
FIG. 5 depicts a flowchart of an exemplary control algorithm for a heater and stirrer within a stirring hot plate.

In the past, hot plates have relied on a single indicator to remind a user that even though the hot plate may be turned off, the surface may still be hot. Embodiments of the present invention include additional indicators as more fully described with respect to the flow chart of FIG. 5 and illustrated in FIGS. 6A and 6B.

When the hot plate is powered on, in step 502, the various display windows of the control panel become active as well. These displays can include, for example, the temperature set point display (e.g., 408). The displays are initialized, or zeroed, in step 504, as part of the power-on sequence of the hot plate. The controller causes the display of zeroes or some other indication (e.g., dashes) to inform the user that while the hot plate has been turned on, a temperature set point has not yet been entered by a user. If a stirrer speed display is present, it can be zeroed in step 504 as well.

As part of its operation, the controller (e.g., 102) samples, in step 506, the temperature setting, or set point, to determine if the heater needs to be turned on. For example, the temperature setting is controlled by a knob attached to the shaft of a potentiometer. As the shaft is rotated, the controller senses the change in resistance and converts it into a corresponding temperature control setting. Alternatively, digital or other input devices could be used to provide the controller with the desired temperature setting.

In response to the set point being entered by a user, the controller will turn on the heater and adjust, in step 508, the heater to maintain the hot plate's temperature according to the set point. The controller accomplishes this function by comparing a temperature sensor value of the hot plate's surface with the control setting sensed, for example, from the potentiometer. Based on this comparison, the controller adjusts the operation of the heater appropriately.

Concurrently with the adjustment of the heater, the controller also updates, in step 510, the temperature set point display (e.g. 408) so that the user can be informed of the temperature which will result from the current knob position. This display can be a seven-segment display, an LCD screen, or other similar displays. Often, the display increments in five-degree steps as the user turns the knob up and decrements in five-degree steps when the user turns the knob down. Five-degree steps are exemplary in nature and embodiments of the present invention contemplate other step sizes such as one-degree or even step sizes greater than five degrees.

When the hot plate is initially turned on, there will be a warm-up period before the hot plate can attain the desired set point. In step 512, the controller determines if the hot plate temperature has yet to reach the set point so that this condition can be visually conveyed to a user. To indicate that the hot plate surface has not yet reached the temperature control setting and, therefore, that the temperature control setting is different than the actual hot plate temperature, the controller can cause the display to blink or flash.

Once the hot plate temperature reaches the set point, then the controller, when performing step 512, will determine that the set point has been reached and cause the display to stop blinking and become solidly lit.

The steps of sampling the temperature setting and updating the display are continually repeated by the controller so that the user's input via the control knob appears to change the display almost immediately.

The temperature of the hot plate surface is sensed, in step 514, to determine if it is above a certain temperature, such as 50° C. If so, then a "Hot" indicator on the control panel (e.g. 406) can be activated. If not, the controller can repeatedly sense the temperature until a determination is made that the "Hot" indicator should be activated. As shown in FIG. 7, the "Hot" indicator may include both a graphical symbol and words. Accordingly, both the words and the symbol, or simply one of them, may be constructed so as to be backlit, or illuminated, to become more visible when activated. Additionally, intermittently blinking the indicator 406 will enhance its visibility as well.

The controller continually monitors the operation of the hot plate so that it can detect, in step 516, when a user turns the power off to the heater or to the entire hot plate. Eventually, upon completion of a desired hot plate operational routine, the user will want to turn off the heater and the controller will determine when the heater knob has been turned off.

Once the power is turned off, the controller will continue to operate in order to determine, in step 518, if the hot plate's surface has cooled to a safe temperature. If the hot plate has not cooled sufficiently, then the potentially dangerous condition is visually displayed, in step 522, to the user. Once the plate has cooled, however, the display can be shutdown, in step 520.

For example, the hot plate surface temperature is sensed to determine if it is above a certain temperature, such as 50° C. If so, then the "Hot" indicator (e.g., 406) can be caused to blink, in step 522, thereby making it more visually noticeable than simply a static display element. Also, the temperature display window (e.g., 408) can have a blinking or scrolling message as an additional indicator that the hot plate surface remains hot even though the hot plate has been turned off. For example, the display could alternate displaying the words "Hot" and "Off". Other types of appropriate displays and phrases could be used as well to alert a user to the hot plate's condition. In addition to using words other than "Hot" and "Off" to indicate the hot condition of the hot plate (e.g., words in a foreign language); an even longer message could be displayed that scrolls across the display 408. Additionally, a temperature other than 50° C. can be selected as the threshold for determining whether or not to power off the displays in step 520 without departing from the scope of the present invention.

The display 408 may be a multi-character display comprised of one or more multi-segment displays, such as a seven-segment display, or some other type of multi-character display. Accordingly, the specific characters that can be displayed on the display 408 partially depends on the display's attributes. For example, in the exemplary display 408 of FIG. 6A, the letter "T" in "HOT" has a vertical line in its center. A conventional seven-segment display does not have these center segments and if one were used in the display 408, then some other recognizable "T" character would need to be used.

Figure 6A:
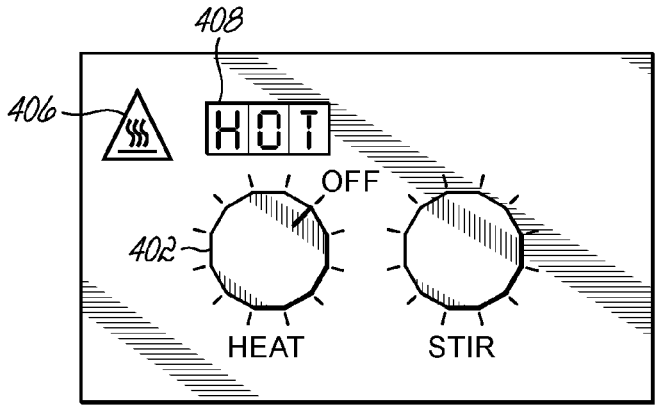
FIGS. 6A and 6B illustrate an exemplary control panel display for indicating the hot plate's condition when the heater has been turned off.
Figure 6B:
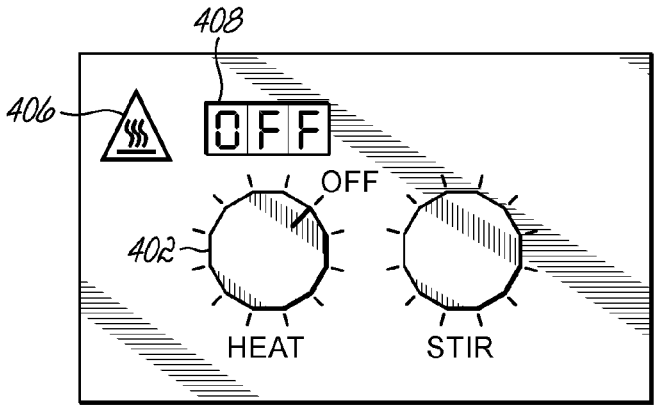

Referring to FIGS. 6A and 6B, an exemplary hot plate control panel is depicted at two different instances in time. Assuming the temperature knob 402 has recently been turned off, the surface of the hot plate will be hot. Accordingly, the indicator 406 blinks or flashes to alert a user. In addition, the display window changes periodically so as to draw the user's attention to the hot plate's condition. At one moment in time, the display 408 can display the phrase "Hot" while at another moment it can display the phrase "Off". Thus, the dynamic nature of the display 408 is visually effective at getting the user's attention while also informing them of both the condition of the temperature setting (i.e., Off) and the current safety concern over the hot plate's temperature (i.e., Hot). The displays in the above-mentioned figures are exemplary in nature and may be comprised of all capital letters, small letters, a mixture of upper-case and lower-case letters, non-letter characters, and various words and phrases.

In addition to the temperature control of the hot plate, the controller also samples, in step 550, a stirrer control setting which can again be a potentiometer or some more complex input device.

In response to the stirrer control setting, the controller adjust the stirrer motor, in step 552. As explained previously, phase control can be implemented using a triac so that the duty cycle of the voltage waveform powering the motor can be adjusted to generate the desired motor speed.

Eventually, the controller detects, in step 554, when a user has turned off the stirrer and initiates braking of the motor. As explained earlier, a rectified phase-controlled signal is used, in step 556 to brake the motor. Duty cycles from approximately 3% to as high as 100% may be used to accomplish the braking. In one embodiment, this duty cycle is applied for a predetermined period of time, such as 1.6 seconds. Alternatively, the motor speed could be sensed and a feedback loop used to the controller such that the controller applies the reduced duty cycle based on the shaft speed and stops applying it once the shaft speed reaches a threshold.

In step 558, the motor is powered off once braking is complete.

While the invention has been illustrated by the description of one embodiment and while the embodiment has been described in considerable detail, there is no intention to restrict or in any way limit the scope of the appended claims to such detail. Additional advantages and modifications will readily appear to those who are skilled in the art.

Therefore, the invention in its broadest aspects is not limited to the specific details shown and described. Consequently, departures may be made from the details described herein without departing from the spirit and scope of the claims which follow.

What is claimed is:

1. A hot plate for supporting a vessel holding a substance to be heated, the hot plate comprising:

a plate having a generally horizontal upper surface adapted to support a vessel containing a substance to be heated;

an electrical heating element in a heat transfer relation with the plate;

a control electrically connected to the heating element; and a control panel electrically connected to the control and including multiple visual displays comprising a hot plate graphic indicator and a multi-character display operable by the control to provide two independent visual indicators that the plate is hot-to-the-touch in response to a temperature of the plate being greater than a first temperature value, wherein the multi-character display is operable by the control to display a temperature of the plate in response to the control applying power to the heating element, and a first message, represented by characters, indicative of the plate being hot in response to the control removing power from the heating element and a temperature of the plate being greater than the first temperature value.

2. The hot plate according to claim 1, wherein the hot plate graphic indicator is intermittently illuminated by the control in response to a temperature of the plate being greater than the first temperature value and the control disconnecting power from the heating element.

3. The hot plate according to claim 2, wherein the hot plate graphic indicator comprises a graphic symbol and a textual portion.

4. The hot plate according to claim 3, wherein at least one of the graphic symbol and the textual portion of the hot plate graphic indicator is backlit on the control panel.

5. The hot plate according to claim 4, wherein the graphic symbol comprises an international symbol for a hot surface.

6. The hot plate according to claim 1, wherein the multi-character display is further operable by the control to display a second message, represented by characters, indicating that the heating element has been turned off in response to the control disconnecting power from the heating element.

7. The hot plate according to claim 1, wherein the multi-character display is further operable by the control to intermittently display the first message simultaneously with the hot plate graphic indicator being intermittently illuminated by the control.

8. A hot plate for supporting a vessel holding a substance to be heated, the hot plate comprising:

a plate having a generally horizontal upper surface adapted to support a vessel containing a substance to be heated;

an electrical heating element adapted to be in a heat transfer relation with the plate;

a control electrically connected to the heating element; and a control panel electrically connected to the control and comprising a multi-character display being operable by the control to display a temperature value representing a temperature set point in response to the control applying power to the heating element, and a first message, represented by characters, indicative of the plate being hot in response to the control removing power from the heating element and a temperature of the plate being greater than a first temperature value.

9. The hot plate of claim 8, wherein the first temperature is approximately 50 degrees C.

10. The hot plate of claim 8, wherein the multi-character display is further operable by the control to display a second message, represented by characters, indicating that the heating element has been turned off in response to the control disconnecting power from the heating element.

11. The hot plate of claim 10, wherein the second message is the word "Off".

12. The hot plate of claim 11, wherein the first message is the word "Hot".

13. The hot plate of claim 8, wherein the first message scrolls across the multi-character display.

14. The hot plate according to claim 10, wherein the multi-character display is further operable by the control to alternately display the first and second messages in response to the control disconnecting power from the heating element.

15. In a hot plate having a heating element for heating a plate supporting a vessel containing a substance to be heated, a control panel comprises a visual indicator indicating a plate temperature greater than a first temperature value, the improvement comprising:

display characters displaying a temperature of the plate in response to power being applied to the heating element, a first message comprising the word "Off" in response to power being removed from the heating element, and a second message comprising the word "Hot" and warning that the plate temperature is greater than the first temperature and power is removed from the heating element.

16. In a hot plate having a heating element for heating a plate supporting a vessel containing a substance to be heated, a control panel comprises a visual indicator indicating a plate temperature greater than a first temperature value, the improvement comprising:

display characters displaying a temperature of the plate in response to power being applied to the heating element, a first message, represented by characters, in response to power being removed from the heating element, and a second message, represented by characters, warning that the plate temperature is greater than the first temperature and power is removed from the heating element wherein the first message is alternately displayed with the second message in response to power being removed from the heating element.

17. The hot plate according to claim 16, wherein the visual indicator blinks on and off in response to power being removed from the heating element and a plate temperature greater than the first temperature value.

18. The hot plate according to claim 17, wherein the second message is displayed when the visual indicator blinks off.

19. The hot plate according to claim 17, wherein the visual indicator comprises an international symbol for a hot surface.

* * * * *